United States Patent [19]

Kranz et al.

[11] Patent Number: 4,898,342

[45] Date of Patent: Feb. 6, 1990

[54] MISSILE WITH ADJUSTABLE FLYING CONTROLS

[75] Inventors: Walter Kranz, Taufkirchen; Werner Schnäbele, Wolfratschausen both of Fed. Rep. of Germany

[73] Assignee: Messerschmitt-Bölkow-Blohm GmbH, Munich, Fed. Rep. of Germany

[21] Appl. No.: 283,628

[22] Filed: Dec. 13, 1988

[30] Foreign Application Priority Data

Dec. 17, 1987 [DE] Fed. Rep. of Germany ..... 3742836

[51] Int. Cl.[4] ..... F42B 15/02

[52] U.S. Cl. ..... 244/3.21; 102/208

[58] Field of Search ..... 244/3.21, 3.22, 3.1; 102/208

[56] References Cited

U.S. PATENT DOCUMENTS

| | | | |
|---|---|---|---|
| 4,193,567 | 3/1980 | McCarty, Jr. | 244/3.16 |
| 4,512,537 | 4/1985 | Sebestyen et al. | 244/3.21 |
| 4,589,594 | 5/1986 | Kranz | 244/3.22 |
| 4,681,283 | 7/1987 | Kranz | 244/3.22 |

FOREIGN PATENT DOCUMENTS

| | | | |
|---|---|---|---|
| 3503041 | 9/1986 | Fed. Rep. of Germany | 244/3.21 |
| 3606423 | 9/1987 | Fed. Rep. of Germany . | |

*Primary Examiner*—Charles T. Jordan

*Attorney, Agent, or Firm*—Kenyon & Kenyon

[57] ABSTRACT

A missile with adjustable flight controls capable of altering the missile's flight path is disclosed. The missile comprises an electric generator and control electronics. The electric generator is used in this invention both to provide electrical power to the control electronics and to regulate the flight controls. A mechanical connection is created between the generators rotor and the flight controls. The generator is electrically coupled to the control electronics through an electrically variable load. The control electronics alters the load which varies the rotational speed of the generator. This in turn affects the flight controls and the flight path is altered accordingly. The invention is small and compact, allowing its use in small missiles such as mortar or artillery shells.

9 Claims, 3 Drawing Sheets

MISSILE WITH ADJUSTABLE FLYING CONTROLS

FIELD OF THE INVENTION

The present invention relates to the field of missiles with self-contained flight control apparatus. More particularly, it relates to missiles with an electrical generator used both for providing electrical power and for adjusting the flight path of the missile.

BACKGROUND OF THE INVENTION

It is known in missiles to provide electrical power to flight control devices by means of an electric generator. The rotor and stator of the generator are arranged on the missile so that the rotor can rotate relative to the stator.

U.S. Pat. No. 4,512,537 discloses a rotating missile whose head rotates about the missile's longitudinal axis. The head has two fixed and two canard-type wings mounted thereon. When the missile is launched, the head initially corotates with missiles. As flight continues, the adjustable canard-type wings eventually brake the head, slowing its rotation relative to the rest of the missile, so relative rotation between the head and missile occurs. The head of the missile contains two rotor windings and the body of the missile contains 2 stator windings. One stator and one rotor winding are coupled to an alternator, which supplies electrical power to the missile's electronic controls. The other stator and rotor comprises a motor which regulates the adjustable canardtype wings. The regulating control signal is provided by the electronic controls with the help of an optical sensor. Based on the control signals, the missile is guided to its target by adjusting the canard-type wings with the help of the motor, according to the laws of proportional navigation.

U.S. Pat. No. 4,193,567 discloses a missile with a rotating head, the rotation being sustained by means of an pre-adjusted fin. The permanent magnet of an electric generator is coupled to the head. The generator supplies electric power to the flight controls. An optical target seeker is located in the rotating head with a slotted window. Flight control signals are determined in the flight control electronics in response to the target seeker's signal. A control nozzle, which is supplied with ram air through a slot between the missile body and head and which corotates with the missile housing, serves to control the flight path. A small D.C. motor alters the space between the head and body, thereby varying the volume of air flowing through the slot.

The known systems for missile flight control, despite their usefulness, have certain problems. They tend to be large, therefore only usable in larger missiles. Additionally, the number of different components makes operational reliability a problem.

It is an object of this invention to simplify the design of a missile flight control system, producing a design that is of small construction, yet effective and reliable.

SUMMARY OF THE INVENTION

These objects and others are fulfilled by the present invention wherein the rotor of the electric generator, which generator is located within the missile body, is mechanically coupled to the flight control air vanes or nozzles. These vanes or nozzles rotate about the missile's longitudinal axis, thereby turning the rotor within the stator. The missile's electronic flight control system derives target location information from a sensor located in the missile's nose. By using these signals to vary the electric load coupled parallel to the generator, the rotational speed of the generator can be selectively controlled. The proper use of this rotational speed control results in asymmetric flight control forces being generated, which gradually steers the missile to target.

If necessary, the rotor may be coupled to the flight control air vanes by gears.

The present invention thus eliminates the separate servo-motor used in the prior art to adjust the flight controls, reducing the number of parts required and allowing for very small construction. The present invention is small enough for use in artillery and mortar shells.

German Pat. Nos. 3,317,583 and 3,503,041 and German Published Pat. No. 3,606,423 are cited here as possible future application examples for the present invention. The specifications of these references describe a brakeuused to regulate the missile's flight controls. According to the present invention, the brake can be replaced by an electric generator of the proper design, which would additionally supply all the power needed by the missile's electronic controls.

To drive the electric generator, either external or internal missile energy can be used. Examples of the former include an electric generator with a stator and rotor driven by fins adjusted at an angle to the flight direction or a generator with a pendulum movement driven by ram air. Examples of the later include driving the electric generator by using missile engine gases or an additional internal gas generator which supplies a control nozzle.

These and other objects and advantages of the invention will appear more clearly from the following specification in connection with the accompanying drawings, in which:

DETAILED DESCRIPTION

Figure 1:
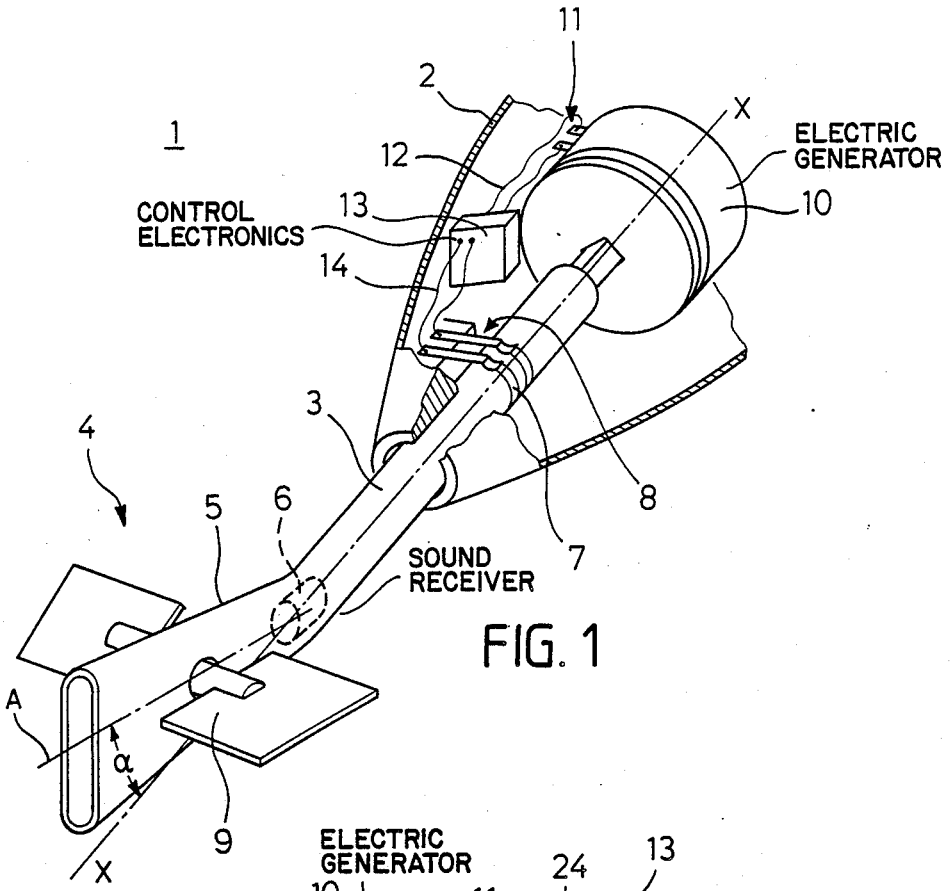
FIG. 1 is a partial cutaway view of the nose cone of a missile containing the present invention.

Referring to FIG. 1, missile 1 has a nose cone 2 formed in the shape of an give. Shaft 3, which protrudes out of nose cone 2, extends along the missile's longitudinal axis X. Bearings, which are not shown here, enable shaft 3 to rotate around the X axis.

An acoustical direction sensor is connected to shaft 3. The sensor features slot-shaped hollow tube 5 with an axle center A tilted at an angle $\alpha$ with respect to the missile's longitudinal axis X. Sound receiver 6 is mounted at the point of intersection of axes A and X. The output signals from receiver 6 are conducted over wires within shaft 3 to distributor 7, which remain in contact with external sliders 8 even when shaft 3 is rotating.

A stationary, interconnected wing pair 9 is attached to hollow tube 5. The end of shaft 3, which extends into nose cone 2 of missile 1 is connected to a rotor (not shown) of electric generator 10. Electric generator 10 has two current connections 11 from which connection lines 12 lead to control electronics 13. Lines 14 couple external sliders 8 to control electronics 13.

As missile 1 flies through the air, it is necessary for the missile to rotate about axis X for stability. Seeker head 4, containing wing pair 9, rotates separately from the missile, driven by the wing pair. In a preferred embodiment, the wing pair is tilted in such a way that seeker head 4 rotates about axis X in the opposite direction from the rotation direction of missile 1. Although tilted wing pair 9 exerts a constant transverse force on missile 1, the force is constant in all directions and results in an average of zero effective force being applied to the nose cone 2 due to the relatively fast rotation speed of seeker head 4.

The relative rotation of missile 1 and seeker head 4 results in electrical power being generated in electrical generator 10. The electrical power is fed through wiring pair 12 to control electronics 13, eliminating the need for a supplemental power source to supply the electronics.

During the rotation of seeker head 4, sound receiver 6 receives acoustic signals from objects and emits corresponding output signals, which are conveyed to control electronics 13 through distributor rings 7, sliders 8 and wiring 14. During a rotation of seeker head 4, control electronic 13 chooses one relevant signal which corresponds to a specific target or type of target. If this target appears in the field of view of seeker head 4, the resistance in the electric circuit leading to connections 11 of generator 10 is reduced by control electronics 13, whereby the rotor of generator 10 is decelerated relative to the stator. This results in the rotative speed of seeker head 4 also being decreased. As soon as signals are no longer received from the relevant target, seeker head 4 is allowed to resume its original rotative speed. During the time it takes to decelerate the rotative speed of seeker head 4, a transverse force is exerted on the missile, turning it in the direction of the target. This process is repeated over several revolutions, until the target disappears in the direction of the longitudinal missile axis, out of seeker head 4's field of view. If, as the missile continues its trajectory, the target is again detected, the foregoing process is repeated, until the missile flies directly into the target.

Figure 2:
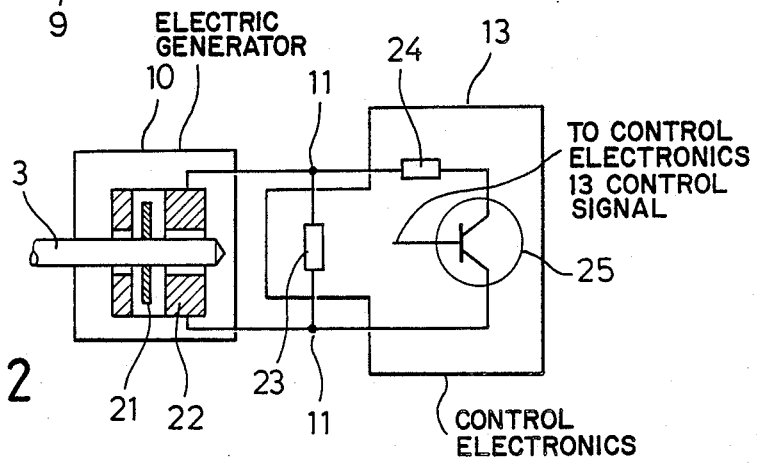
FIG. 2 is a schematic diagram of the generator used in the present invention.

Referring to FIG. 2, shaft 3 is shown connected to rotor 21 and fixed to the inside of generator 10. The rotor can be comprised of segment-shaped permanent magnets. Stator winding 22 is coupled to connections 11. Control electronics 13 contains the variable ohmic load, depicted as resistor 23. Resistor 24 is coupled to the emitter of transistor 25. This combination is then coupled in parallel to resistor 23 by coupling one lead of resistor 24 to resistor 23 and the collector of transistor 25 to the other lead of resistor 23. The base of transistor is 25 coupled to control electronics 13. Usually, transistor 25 does not conduct. When a reduction in rotation speed is called for, transistor 25 is allowed to conduct. This allows current to flow through resistor 24, which reduces the circuit's resistance dramatically, by means of known principles. The resistance value of resistor 24 is adjusted by measuring the speed of rotation, to effect the desired braking of shaft 3. The braking action can be continued until seeker head 4 is almost "de-spun". Stopping the rotation is to be avoided, as power output would fall to zero.

During the rotation of rotor 21 relative to stator 22, corresponding voltage fluctuations result in generator 10's output voltage, due to the polar distribution of rotor 21. These voltage fluctuations can be evaluated in control electronics 13. If necessary, they can be counted and used to activate an ignition device. It is further possible to utilize electric generator 10 as a transducer to measure the rotation position between the missile housing and seeker head 4. This can also be done by counting the voltage fluctuations that occur, whereby a pole on rotor 21 and stator 22 is configured to generate a characteristic voltage impulse during the run through of rotor 21. This voltage impulse can then serve as a reference impulse for a specific rotation position.

Figure 3:
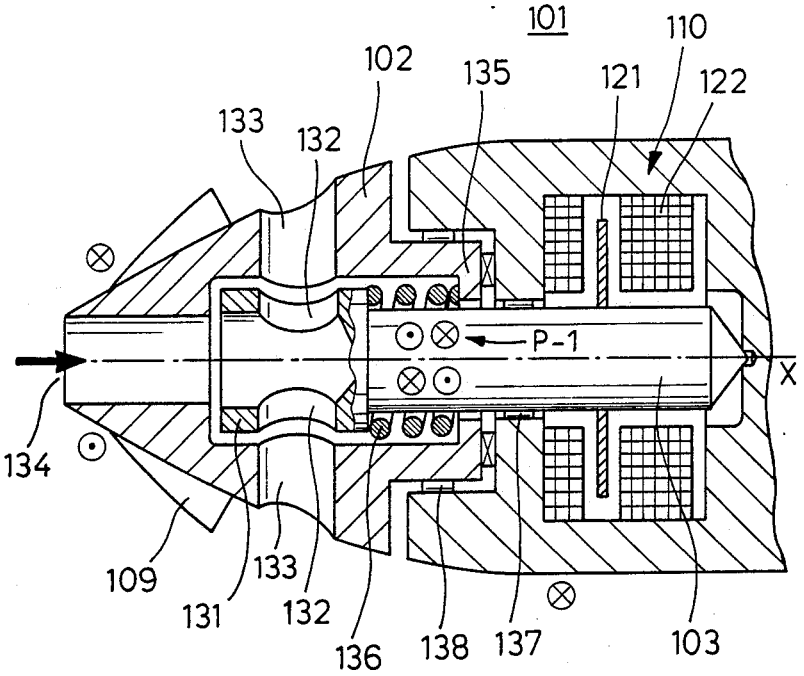
FIG. 3 is a cross section of the nose cone of a missile containing another embodiment of the present invention.

FIG. 3 shows another embodiment of the present invention. Nose cone 102 is embedded in the body of missile 101. Air flow over the missile causes adjusted fins 109 to set the missile head into rotation. Shaft 103 is located within the missile housing and is permanently coupled to rotor 121 of electric generator 110. Stator windings 122 are sketched in the missile housing. The control electronics and target sensor(s) are not shown in this figure. The wiring circuit of generator 110 is similar to that shown in FIG. 2.

Shaft 103 extends into nose cone 102 and has mounted on its front end coaxial flow distributor 131, open to the front, with two openings 132 situated on opposite sides of the longitudinal missile axis. Nose cone 102 is designed with blow out ports 133, which ports run radially and match up with openings 132. The openings 132 and 133 are positioned so that at the extremes of the rotation, one of the openings 132 communicates over its entire diameter with the allocated blow out port 133, while the other opening 132 is closed. In a mid-position, the contact ratio between both openings 132 and the allocated blow out ports 133 is 50%.

Ram air duct 134, which discharges into the front open end of flow distributor 131, is placed concentrically to the longitudinal axis X of missile 101.

Helical spring 136 encircles shaft 103 and is clamped between the rear end of flow distributor 131 and flange 135, which is situated between the flow distributor and electric generator 110.

An angle of rotation transmitter 137 is provided between shaft 103 and the missile housing. Another angle of rotation transmitter 138 can be mounted between missile nose cone 102 and the missile housing. The output signals from angle of rotation transmitters 137 and 138 are fed to control electronics.

During missile 101's flight, nose cone 102 is kept in constant rotation by incident air flow on fins 109. Using the output signals from the angle of rotation transmitters 137 and 138, the electric load for electric generator 110 is automatically adjusted by the control electronics, so that the contact ratio between openings 132 and 133 is essentially 50%. Thus, air streaming into ram air duct 134 emerges radially on both sides of the missile, in approximately equal amounts. Consequently, no transverse force acts on missile 101. The contact ratio of 50% is maintained, for example, by a pulsed switching of the electric load of generator 110. The helical spring 136 is in a semi-taut state at the time of this zero directed force command.

If a directed transverse force is to be exerted on missile 101, two possible methods of operation can be used. In the first, the braking action on the shaft can be increased by reducing the electric load of generator 110, or two, the braking action can be reduced by increasing the electric load.

In the first case, helical spring 136 is allowed to tauten and winds tightly around shaft 103 up to fitting 135. In this position the contact ratio between the upper opening 132 and allocated upper blow out port 133 is then 100%, with the lower blow out port being completely covered. This full "upwards" command can be cancelled by reducing the braking action, whereby helical spring 136 slackens and, at the same time, flow distributor 131 is thrust in the direction of the location required for zero directed force.

In the second case, the braking action is reduced accordingly, whereby helical spring 136 slackens and transports flow medium distributor 131 to a position where the lower opening 132 in FIG. 3 communicates at a rate of 100% with the lower blow out port 133. This corresponds to a full "downwards" command. This command can again be converted to a zero directed force command, by once again increasing the braking action.

Intermediate positions between the extreme "upwards" and "downwards" commands are possible with appropriate pulse-width modulating control of the load current of electric generator 110.

Figure 4:
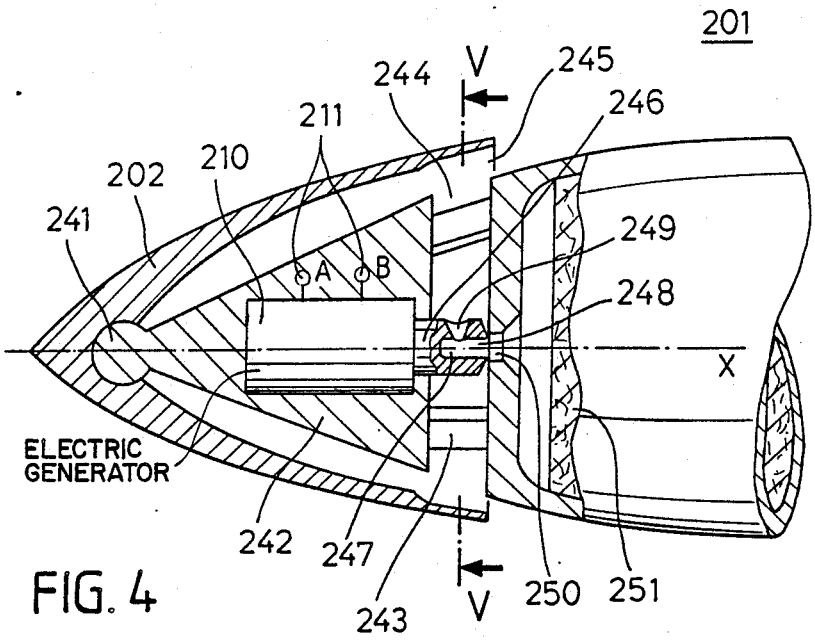
FIG. 4 is a cross section of the nose cone of a missile containing still another embodiment of the present invention.
Figure 5:
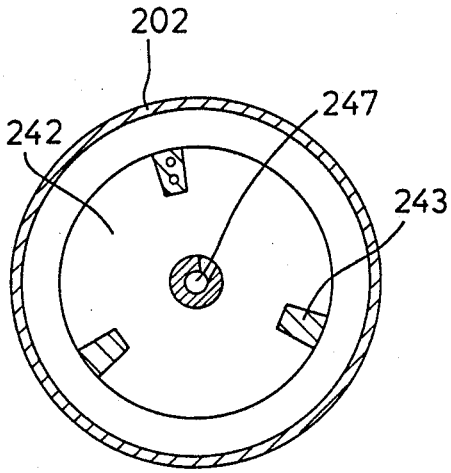
FIG. 5 is a cross section of the nose cone taken along the line V—V shown in FIG. 4.

In FIGS. 4 and 5 the front section of missile 201 is shown with its nose cone 202 modeled as an give-shaped casing, which pivots to all sides on hinged bearing 241. Hinged bearing 241 is mounted on the front section of cone 242, which rests on the missile housing supported by braces 243, so that a gap 244 remains between cone 242 and the housing of missile 201. The mass center of the swiveling projectile nose 202 lies approximately in the center of hinged bearing 241. The casing of the projectile nose 202 overlaps gap 244 on all sides, whereby a revolving aperture 245 remains between the rear edge of the casing and the missile housing.

Electric generator 210 with a rotor (not shown) and a stator is situated in cone 242. The rotor is driven by shaft 246 which has a rotary nozzle 247 attached thereto. Rotary nozzle 247 has a gas duct 248, which duct is open in the direction of the housing of missile 201 and is concentric to the longitudinal missile axis X. Exhaust nozzle 249 branches off radially from the duct with a direction of thrust that does not intersect the missile's longitudinal axis X. Gas generator 251 has an opening 250 which communicates with the open end of gas duct 248.

The control electronics and any possible sensors are not depicted in this embodiment. Only the connections 211 of electric generator 210 are sketched.

When gas generator 251 is ignited during or after the start-up of the missile, gas flows into rotary nozzle 247, setting it into very fast rotation as a result of the asymmetrical design of exhaust nozzle 249. As shaft 246 of rotary nozzle 247 is connected to the rotor of the electric generator, this rotor generates electric power to supply the control electronics and other electronics, as desired. The gas jet emanating from exhaust nozzle 249 strikes the rear end of nose cone 202 and then emerges from aperture 245 with a component radial to the missile axis, in the normal flight attitude of missile 201, aperture 245 is of the same size over its entire circumference. As the nose cone's rotation is quite high, no transverse force is generated normally.

If a transverse force is needed, the external load of the electric generator would be reduced, in the same manner as described before. This would in turn decelerate the rotation of the rotary nozzle 247. If this deceleration takes place only over a specific area of the angle of rotation, then, within this area, a force which is greater percentage-wise then in the other areas of the angles of rotation is exerted upon the missile head 202. The missile nose cone, being able to swivel to all sides, is thus turned in the direction of this greater force. This in turn alters the incident air flow from missile nose cone 202 which finally "tows" the missile in this new direction. This effect is reinforced due to the fact that the aperture 245 becomes larger in the selected area of angle of rotation, which in turn increases the volume of gas emanating therefrom, causing an increase in the radial transverse force exerted on the missile 201 in the desired direction.

The various embodiments of this missile control system are only exemplary designs. In the embodiments shown in FIGS. 4 and 5, it would be possible to control the missile not by adjusting the swiveling missile head, but rather by using the exhaust jet blowing directly out of the exhaust nozzle, whereby the rotation of the nose cone would be modulated accordingly. In the embodiment of FIG. 3, one blow out part in the missile nose cone could be selected, along with one opening in the flow distributor, whereby the contact ratio of these two openings would be varied to regulate the desired transverse force. In the embodiment of FIG. 1, it would be possible to mount the interconnected wing pair in the area of the shaft that is connected to the electric generator. To regulate the transverse force, at least one of the rudders would be adjustable. Such an arrangement is shown in German Published Patent Application No. 36 06 423.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A missile with target sensor means comprising:

adjustable flight control means;

electric generator means having a rotor and a stator, the rotor and stator being mounted on two sections of the missile capable of rotary movement relative to one another, the rotor being mechanically coupled to the adjustable flight control means;

variable electric load means coupled to the electric generator means for providing variable electric resistance; and control electronic means coupled to the target sensor means and the variable electric load means, the control electronic means receiving target location signals from the target sensor means and altering the variable electric load in response to the target location signals, the changes in electric load varying the rotational speed of the rotor which in turn varies the rotational rate of the adjustable flight control means, resulting in an altered flight path.

2. The missile of claim 1 wherein the adjustable flight controls comprise rotating external control vanes.

3. The missile of claim 1 wherein the adjustable flight controls comprise rotating control nozzles.

4. The missile of claim 1 wherein the adjustable flight controls comprise rotating air spoilers.

5. The missile of claim 1 wherein the rotor of the electric generator means is coupled to adjustable flight control means comprising external air vanes, the air vanes being set into rotary motion by the airstream over the missile.

6. The missile of claim 5 wherein the external air vanes are in the forward section of the missile.

7. The missile of claim 6 wherein the external air vanes comprises the forward section of the missile.

8. The missile of claim 1 wherein the adjustable flight controls are driven into rotary motion by internal missile energy.

9. The missile of claim 3 wherein the rotor of the electric generator means is coupled to the rotating control nozzles, which nozzles are set into rotation by gas generated internally to the missile.

* * * * *